United States Patent [19]

Schlough

[11] 4,236,706

[45] Dec. 2, 1980

[54] SIGNATURE CONVEYOR FOR USE WITH INSERTER AND STITCHER

[75] Inventor: James R. Schlough, Easton, Pa.

[73] Assignee: Harris Corporation, Melbourne, Fla.

[21] Appl. No.: 31,203

[22] Filed: Apr. 18, 1979

[51] Int. Cl.[3] ..... B42B 1/02

[52] U.S. Cl. ..... 270/53; 270/54

[58] Field of Search ..... 270/51–54, 270/37, 45, 4, 12, 15, 17, 18

[56] References Cited

U.S. PATENT DOCUMENTS

| | | | |
|---|---|---|---|
| 2,791,421 | 5/1957 | Schramm | 270/54 |
| 3,032,336 | 5/1962 | Heigl et al. | 270/53 |
| 3,057,620 | 10/1962 | McCain | 270/53 |
| 3,087,721 | 4/1963 | McCain | 270/54 |
| 3,481,594 | 12/1969 | McCain et al. | 270/54 |
| 3,554,531 | 1/1971 | Heigl | 270/53 |
| 3,561,752 | 2/1971 | McCain | 270/54 |
| 3,664,655 | 5/1972 | McCain et al. | 270/53 X |
| 3,692,299 | 9/1972 | McCahon et al. | 270/54 |
| 4,085,927 | 4/1978 | Muller | 270/54 |

FOREIGN PATENT DOCUMENTS

| | | | |
|---|---|---|---|
| 1817648 | 7/1970 | Fed. Rep. of Germany | 270/52 |
| 716905 | 12/1931 | France | 270/53 |

*Primary Examiner*—E. H. Eickholt

[57] ABSTRACT

A signature conveyor for use with an inserter or collator station and a stitcher station includes a saddle conveyor for moving signatures with a folded edge up along a path through a number of such stations. The saddle conveyor includes a chain to which steeples are connected to support the signatures and move them along the path. A rail guides the chain and the steeples to control their orientation along the conveyor path. Through a first portion of the conveyor path where the conveyor passes an inserter or collator station the steeples are centered directly beneath the folded edge or backbone of the signatures with the two leaves of the signature extending over the two sides of the steeples. During a second portion of the path the steeples are tilted and move out of the area directly beneath the backbone of the signatures. As the steeples move from directly beneath the backbone of a signature, a guide member simultaneously becomes located between the faces of the signature to support one of the faces of the signature. This causes the faces to be separated further. At some stations devices move up between the downwardly opening centerfold of the signature toward the backbone. These stations perform one of a number of operations on the backbone of the signatures including stitching and removing signatures from the saddle conveyor.

12 Claims, 11 Drawing Figures

SIGNATURE CONVEYOR FOR USE WITH INSERTER AND STITCHER

BACKGROUND OF THE INVENTION

The invention relates generally to a saddle conveyor for use in signature handling systems. More specifically, the present invention relates to a tilting chain for a saddle conveyor which allows access to the bottom of the folded edge or backbone of a signature from beneath the saddle conveyor.

A saddle conveyor has been used to move the signatures between a number of operation stations. The stations may have various functions such as collating and/or stitching. A saddle conveyor collects the signatures, carries them between the various stations, and finally locates them for transfer to another conveyor.

One known method of conveying signatures includes pushing the signatures along a stationary saddle shaped like an inverted "V". At its apex the inverted "V" has a channel in which pusher fingers are reciprocated to incrementally advance the signatures on the saddle. See, e.g., U.S. Pat. No. 3,366,225. In such system the backbone of a signature has not been accessible from below to devices for acting thereon.

Conveyor systems are known in which the bottom of the backbone of a signature has been accessible. Examples are shown in U.S. Pat. Nos. 937,925, 1,400,725 and 3,786,979. in U.S. Pat. No. 937,925 an endless chain is used to periodically advance signatures through a stitcher. Pusher fingers connected with the chain extend through an opening formed along one side of the saddle. In U.S. Pat. No. 1,400,725 an opening is formed in one of the sides of the saddle and a mechanism reciprocates in the opening to advance the signatures. In these two conveyors a slot at the apex of the saddle between the two saddle faces receives a stationary stitching mechanism for stapling the signatures when they have been advanced to the proper position. There are several disadvantages to this system among which are the fact that the stitching operation is not performed "on the fly" and thus the signatures must be stopped and started.

U.S. Pat. No. 3,786,979 shows a design which permits access to the underside of the backbone of a signature and which provides a continuously moving stream of signatures on a conveyor. In the design disclosed in this patent two conveyor chains are disposed in a side by side arrangement. Each chain carries pusher pins to engage the back edges of a group of signatures and supports which support one side or leaf of the signature groups. Access from below to the backbone of the group of signatures for a stitcher assembly is provided by the gap between the conveyor chains. The stitcher is mounted on a reciprocating assembly to perform stitching on the fly.

Although this design enables the signature group to be stitched on the fly, the use of two chains is an expensive and unnecessary duplication. In addition, when the chains stretch, they do not stretch evenly and this causes pusher pins mounted to one chain to be ahead or behind the pins on the other chain.

SUMMARY OF THE INVENTION

The present invention provides a new and improved signature conveyor for use in transporting signatures along a path through a variety of stations at each of which a work operation is performed. The present invention enables the use of a single conveyor chain to carry signatures in a continuously moving stream from a collator or inserter through a stitching station to a transfer station.

At the collating station signatures are fed onto the conveyor to form groups with the backbone supported by the conveyor. At the stitching station unobstructed access to both the top and bottom sides of the backbone is required and the backbone must be accurately positioned in order for the station to perform its operation. At the transfer station access to the backbone from below is also required. A signature conveyor constructed according to the present invention provides signature supports or steeples which support the folded backbone of a group of signatures where that is required and which can twist out of the way to provide access from below to the bottom of the backbone where that is required.

Each steeple has two sloping sides which meet to form an apex or ridge on which the folded backbone of a signature may rest. The signatures travel with the backbone or folded back edge uppermost and in the direction of the fold while the leaves of the signature rest on the sloping sides of the steeple. When support is required directly beneath the backbone, the steeples are oriented with their apexes uppermost, and the sloping sides are symmetrical about a vertical line through the apex. When access to the backbone from the centerfold is required, the steeples are twisted out of vertical so that one of the (formerly) sloping sides is upright. One leaf of the signature remains supported by the steeple. The other leaf slides along a face of a support member which is positioned for this purpose along the portion of the signature path where the steeples are twisted from vertical.

The steeples are mounted on a single endless chain which in turn is supported and guided by a guide rail. The links of the chain have downward extensions of the link plates which fit and slide along opposite sides of the guide rail while the rollers of the chain rest on the top surface of the guide rail. When the steeples must be vertical, the guiding sides of the guide rail are vertical, and the top surface is horizontal. Further along the signature path, where there must be access to the backbone of the signatures from below, the sides of the guide rail are slanted off vertical. The link plates follow the sides of the guide rail and twist the steeples so that one of the (formerly) sloping sides of the steeple becomes vertical.

To provide access to the backbone of the signatures, the signatures are lifted away from the apex of the steeples by a support member and a signature fold guide. The support member has a face which extends along the conveyor path to support one leaf of the signatures. The top edge of this face upward with respect to the axis of the guide rail and the apexes of the steeples. As the signatures move along the conveyor and reach the portion where the guide rail, chain, and steeples twist, the signatures are opened by an outward flare of a face of the support member.

When a station performs an operation requiring access to both the top and bottom of the backbone of the signature, the backbone must be accurately located and spaced from the apexes of the steeples. To this end the conveyor includes a fold guide which is accurately located relative to such a station. As a collated group of signatures are moved along the conveyor path and reach the location where the steeples have twisted so that one leaf is supported by the steeples and the other leaf is supported by the signature support, the fold guide, which slopes upward along the conveyor path, engages the folded backbone from below to position it properly with respect to the station.

The fold guide is an elongated member extending generally parallel to the direction of the conveyor. The fold guide slants upwardly so that its upper portion increasingly engages the folded back edge or backbone of the signature as the signature moves along the conveyor. When the signature arrives at the end of the fold guide, the backbone and the portions of the leaves immediately adjacent the backbone are supported by the fold guide. The lower portion of one leaf is supported by one side or the tilted steeple, and the lower portion of the other leaf is supported by the support member. Thus, the fold guide serves to accurately locate the backbone of the collated group of signatures.

Once properly aligned, the groups of signatures pass through a station such as a stitcher where wire stitches are pressed through the backbone. Thereafter the signatures are conveyed to an unloading station at which it is also required that the backbone be accessible from below. Therefore the chain guide rail remains twisted from vertical for the length of this unloading station.

The drive sprocket at the downstream end of the conveyor is slanted to receive the chain in a twisted condition as it moves off from the end of guide rail. On the return run the chain is guided by supports which engage the steeples. Along the length of the return run the steeple supports gradually twist the steeples and the chain until they again lie in a vertical plane. For this reason the sprocket at the upstream end of the conveyor rotates in a vertical plane and the chain comes off the upstream sprocket vertically aligned with the upstream end of the chain guide rail.

BRIEF DESCRIPTION OF THE DRAWINGS

The foregoing and other features of the present invention will become more apparent upon a consideration of the following description of one preferred form of the invention taken in connection with the accompanying drawings wherein.

DETAILED DESCRIPTION OF ONE PREFERRED EMBODIMENT OF THE INVENTION

Figure 1:
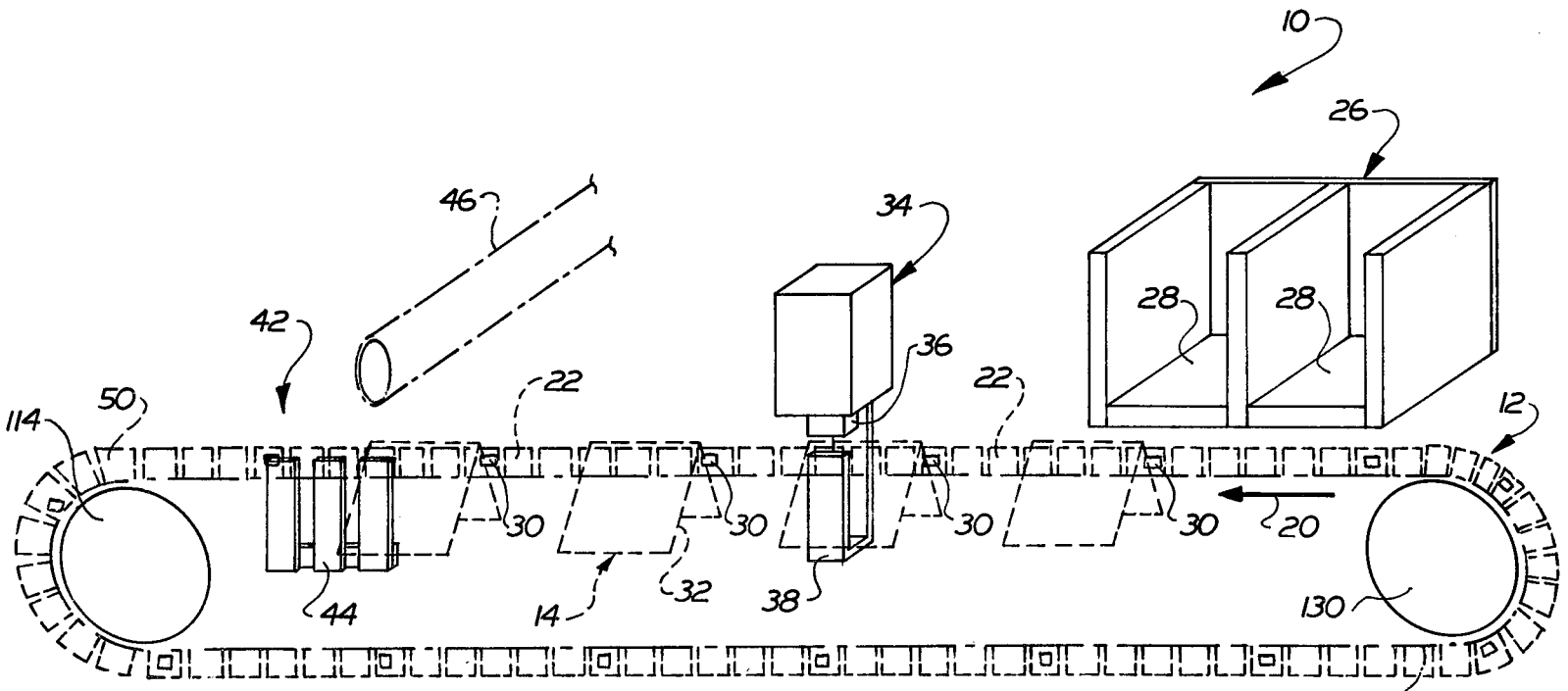
FIG. 1 is a schematic illustration of the components of a signature handling system including a saddle conveyor constructed in accordance with the present invention and having signature supporting steeples.

In a signature handling system, it is advantageous to use a saddle conveyor to continuously move signatures along a path through a series of stations. FIG. 1 illustrates a signature handling system 10, using a saddle conveyor 12 to move signatures or groups of signatures 14.

The saddle conveyor 12 includes a single endless chain 16 which moves the signatures 14 at a constant speed along a path as indicated by an arrow 20 in FIG. 1. The signatures 14 are supported by the saddle conveyor 12 with a folded back edge or backbone 22 of the signature up and two leaves extending downwardly from the backbone over the saddle conveyor 12.

The saddle conveyor 12 guides the signatures 14 through a series of stations 26, 34, and 42. Operations performed at the station 26 require the chain 16 to be directly below the backbone 22 of the signatures 14. Operations are performed at the stations 34 and 42 which require the backbone 22 to be accessible both from above and from the centerfold below. As the conveyor 12 passes through the stations 34 and 42, the chain 16 is tilted out of the area directly below the backbone 22 of the signatures in a manner to be discussed more fully below. The stations 34 and 42 are therefore able to perform operations on the backbone 22 of the signatures 14.

The collating or inserting station 26, the first station along the conveyor path, delivers folded sheets sequentially to form a group of signatures 14 on the saddle conveyor 12 from a signature feeding apparatus 28. As the individual sheets are fed over the saddle conveyor 12 with the backbone 22 up, a pusher 30 engages the trailing edge or foot 32 of one leaf of each of the signatures to move the signatures downstream in the direction indicated by the arrow 20.

A second station is a stitching station 34. The stitching station 34 includes a stitcher head 36 and a clincher 38 which move toward each other from above and below the backbone 22 to bind the separate sheets of the signatures 14 together. The pushers 30 move the signatures 14 downstream into the stitching station 34 from the collating station 26.

A third station is a transfer station 42. The transfer station 42 removes the signatures 14 from the saddle conveyor 12 and delivers them for further handling. The transfer station 42 includes a reciprocable blade mechanism 44 which lifts the signatures 14 from the saddle conveyor 12 to a secondary conveyor 46 for further handling. The continuously moving chain 16 moves the signatures 14 downstream into the transfer station 42 from the stitching station 34.

The saddle conveyor 12 includes steeples 50 which support the signatures 14 at the backbone 22 of each signature while the signature 14 is being moved through the collating station 26. During the portion of the path of the saddle conveyor 12 which extends through the collating station 26 the steeples 50 lie in the area directly beneath the backbone 22 of the signatures 14. The stitching station 34 and transfer station 42 require the clincher 38 and reciprocable blade 44, respectively, to operate on the folded edge or backbone 22 of the signature 14. Therefore, during a subsequent portion of the path of signatures 14 along the saddle conveyor 12, the steeples 50 are guided out of the area directly beneath the backbone 22 of the signatures 14. This movement of the steeples out of the area directly beneath the backbone 22 enables the devices at the stations 34 and 42 to move toward the backbone of the signatures 14 from below.

Figure 3:
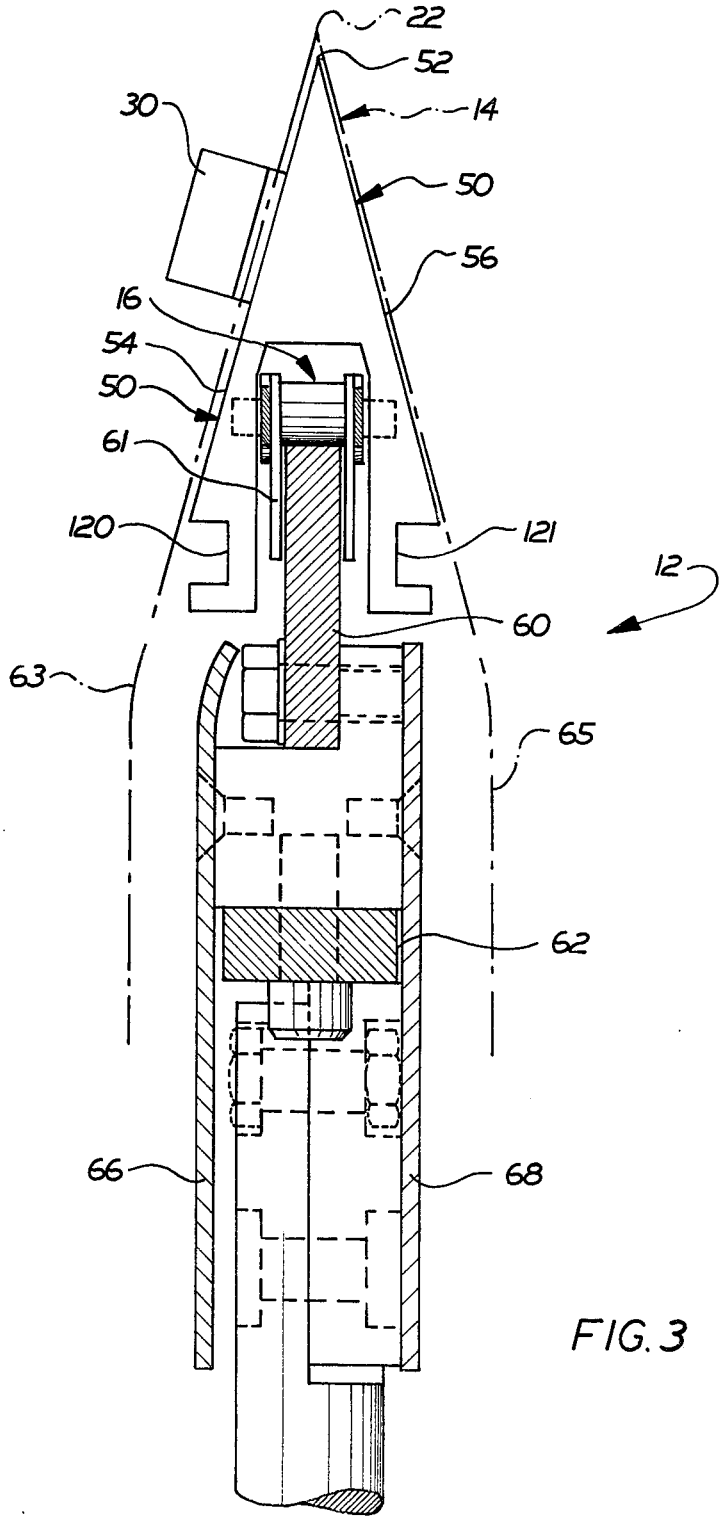
FIG. 3 is a sectional view taken along the line 3—3 of FIG. 2 illustrating the chain and steeple of the saddle conveyor prior to tilting.

The steeples 50 are attached to the chain 16 of the saddle conveyor 12. Each steeple 50 is a triangular prism (FIG. 3) with a ridge or apex 52 uppermost and two angled faces 54 and 56 which lie at an angle of approximately 30° to each other. This is a somewhat more acute angle than has been used in some prior art devices because it has been found that the signatures settle more easily with the backbone 22 on the apex 52 of the steeple 50 when the steeples are more acute. A channel 58 is formed in the base of the steeple 50 by which it is attached to the chain 16. The chain 16 includes extended pins 59 which fit into corresponding recesses in the channel 58 of the steeple in a manner similar to that disclosed in U.S. Pat. No. 2,954,113.

The pushers 30 (FIGS. 2 and 3) are fastened to some of the steeples 50 at suitable spacings along the path of the conveyor 12. Each steeple is about 3 inches long and the pushers 30 are connected to every sixth steeple. The pushers 30 are spaced along the conveyor path to provide some space between the head and foot of adjacent collated groups of signatures 14. The pushers 30 are L-shaped brackets and are fastened by any suitable means such as belts to side 54 of the steepless which faces away from the collating station 26 and stitcher 34.

The chain 16 is an extended link chain and is supported by a rectangular guide rail 60. The chain rollers rest on the top of the guide rail 60, and downwardly extended side plates 61 of the chain links engage the sides of the guide rail. The guide rail 60 is supported by the machine frame 62, and its orientation controls the orientation of the chain 16 and the steeples 50.

Figure 2:
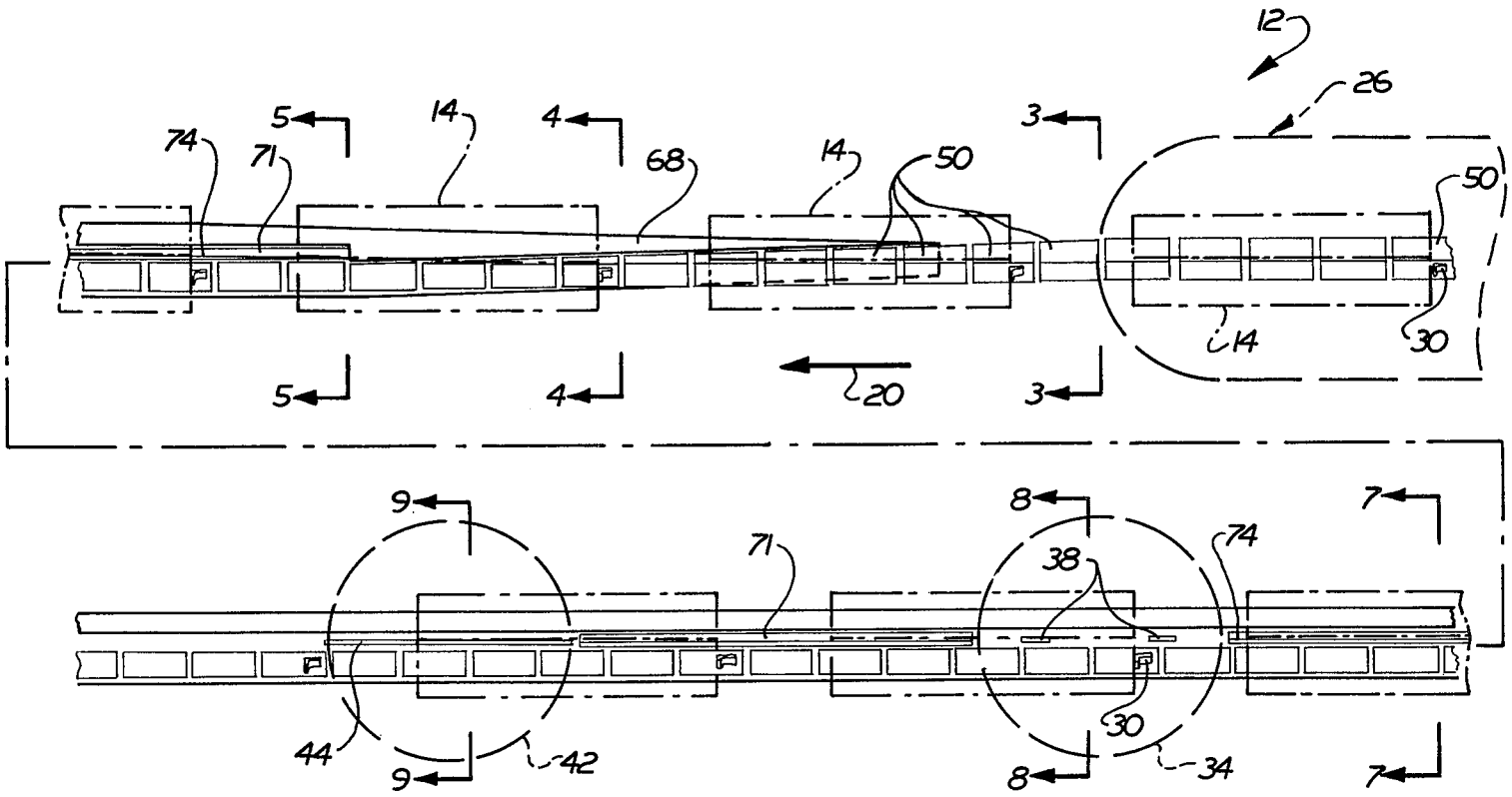
FIG. 2 is a schematic plan view of the saddle conveyor of FIG. 1 showing the steeples tilting downstream of an collating station and illustrating the tilted position of the steeples as the conveyor carries signatures through a stitching station and an unloading or transfer station where the signatures are removed from the conveyor.

The guide rail 60 is aligned vertically at a first portion of the saddle conveyor 12. For this reason the ridge or apex 52 of the steeple 50 is centered directly above the chain 16 during this first portion of the saddle conveyor 12. The second portion of the saddle conveyor 12 begins downstream of the collating station 26 (to the left as shown in FIG. 2). The guide rail 60 is twisted relative to its original vertical position, to move the chain 16 and the steeples 50 out of the area beneath the backbone 22 of the signature 14. The twisting of the rail 60 is gradually effected along the path of the saddle conveyor downstream of the inserter station 26. The total twist of the chain 16 requires the steeple 50 and chain 16 to rotate 15° from their original vertical positions.

Figure 4:
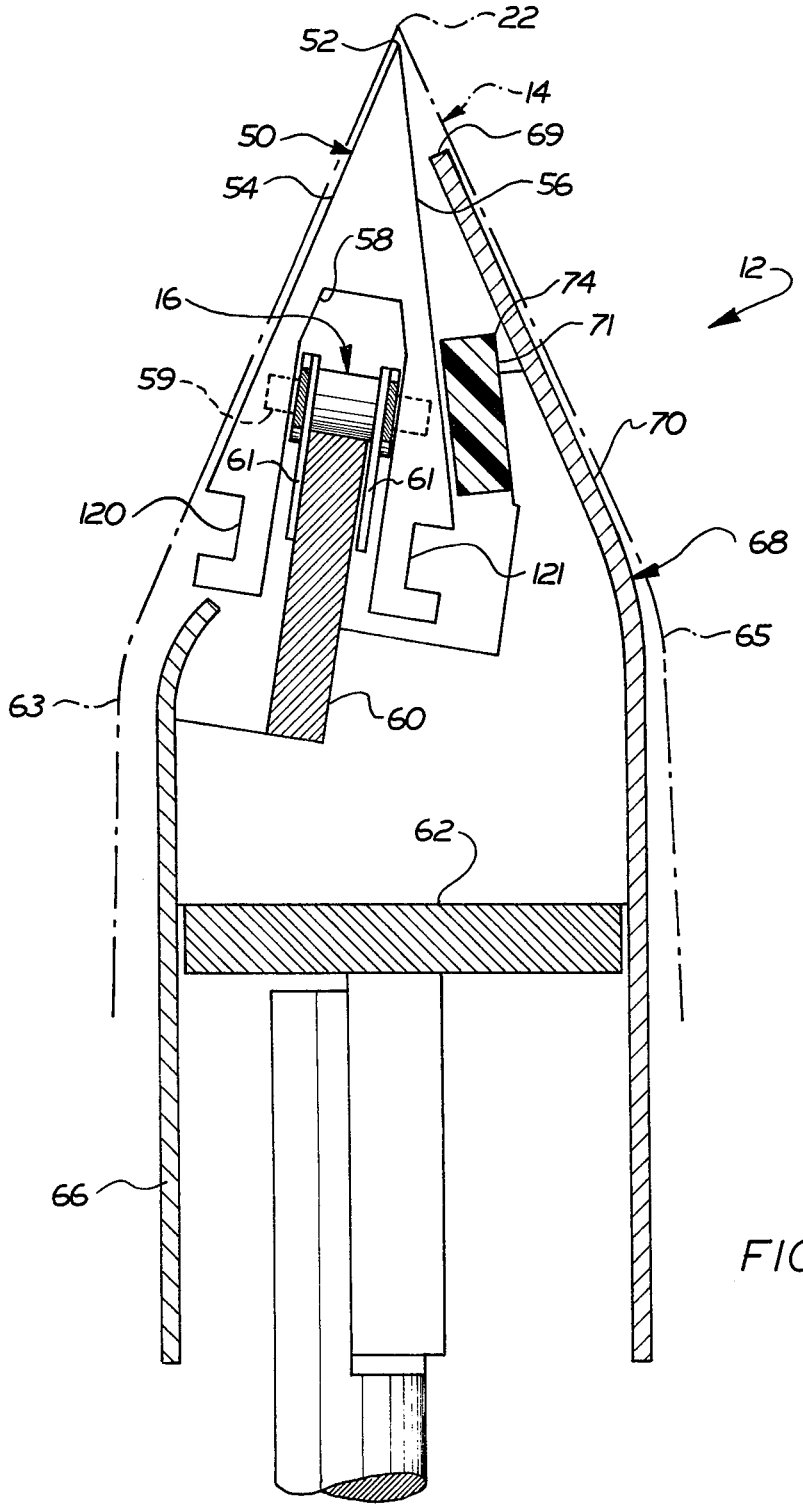
FIG. 4 is a cross sectional view taken along the line 4—4 of FIG. 2 illustrating the chain and a steeple of the saddle conveyor in a partially tilted condition.
Figure 5:
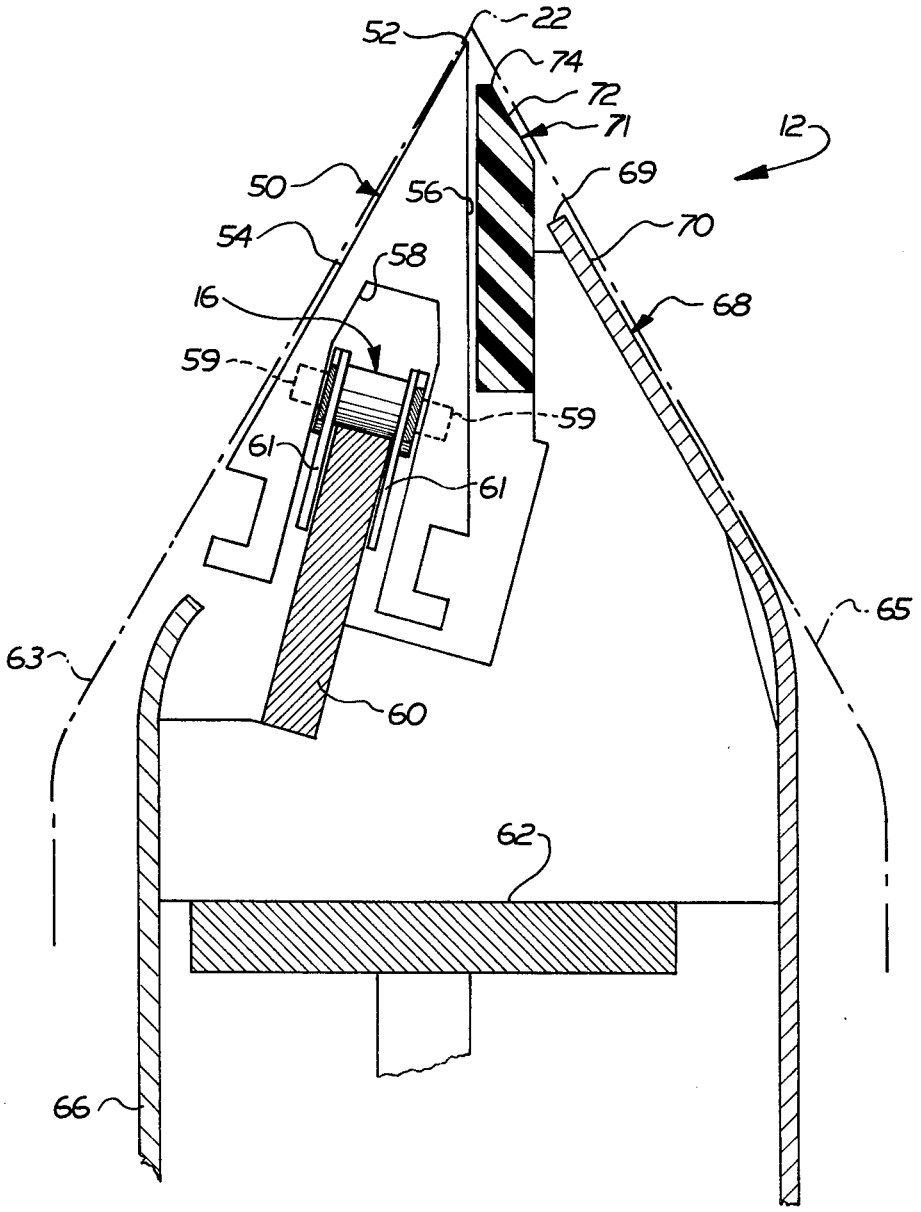
FIG. 5 is a cross sectional view taken along the line 5—5 of FIG. 2 illustrating the chain and a steeple of the saddle conveyor in a partially tilted position with a fold guide between the steeple and a support member, the fold guide partially engaging one leaf of the signature adjacent the backbone.

The guide rail 60 is shaped so that tension in the chain 16 does not tend to lift the chain off the guide rail even though the guide rail is twisted. To accomplish this the portion of the guide rail 60 in which the twist occurs is helical. The axis of the helix is a straight line connecting the centers of the rollers of the chain 16. The steeples 50 appear to rotate about the pitch line of the chain 16 as they twist from a vertical position (FIG. 3) to a slanted position (FIGS. 4 and 5).

During the twisting of the chain 16, the face 54 of the steeple 50 and a support member 68 cooperate to open the signature 14. The opening of the signature allows room for operations on the backbone 22. When the chain 60 and steeples 50 are twisted from vertical (FIG. 4), one of the downwardly extending leaves 63 of the signature 14 is supported by the face 54 of the steeple 50 and also by a stationary guide member 66 located directly beneath the face 54 of the steeple. The other leaf 65 is supported on face 70 of the support member 68. At this point along the path of the conveyor 12, the face 54 of the steeple 50 and the face 70 of the support member 68 form an angle of about 50° to each other.

The top edge 69 of the support member 68 slopes upwardly relative to a horizontal plane along the portion of the conveyor 12 where the chain 16 and steeples 50 twist from vertical. Along the same portion of the conveyor path the face 70 of the support member 68 on which the leaf 65 of the signature slides flares outward to open the signature 14 further. When the signature 14 reaches the position on the conveyor 12 where the steeples 50 are twisted the maximum amount of 15°, the face 54 of the steeple lies at a 60° angle to the face 70 of the support member 68. This is in contrast with the upstream portion (FIG. 3) of the conveyor adjacent the inserter 26 where the leaves 63 and 65 of the signature 14 rest on the faces 54 and 56 of the steeple 50 and form a 30° angle to each other. The opening of the signature 14 provides additonal room in the centerfold for the mechanisms of the stitching and transfer stations 34 and 42 (FIGS. 1 and 2).

In order for the stitching station 34 to properly place the stitches in the backbone 22 of the signature 14, the signature must be accurately located and no longer resting on the apex 52 of the steeple 50. To this end a fold guide 71 (FIG. 4) is provided between the apex 52 of the steeple 50 and the signature support 68. An upwardly sloping edge 74 of the fold guide 71 guides the backbone 22 of the signature 14 up and away from the apex of the steeple 50 just downstream of the portion of the conveyor 12 where the chain 16 and steeples 50 become twisted from vertical.

Figures 6A, 6B, 6C, 6D, 6E, 6F, 6G:
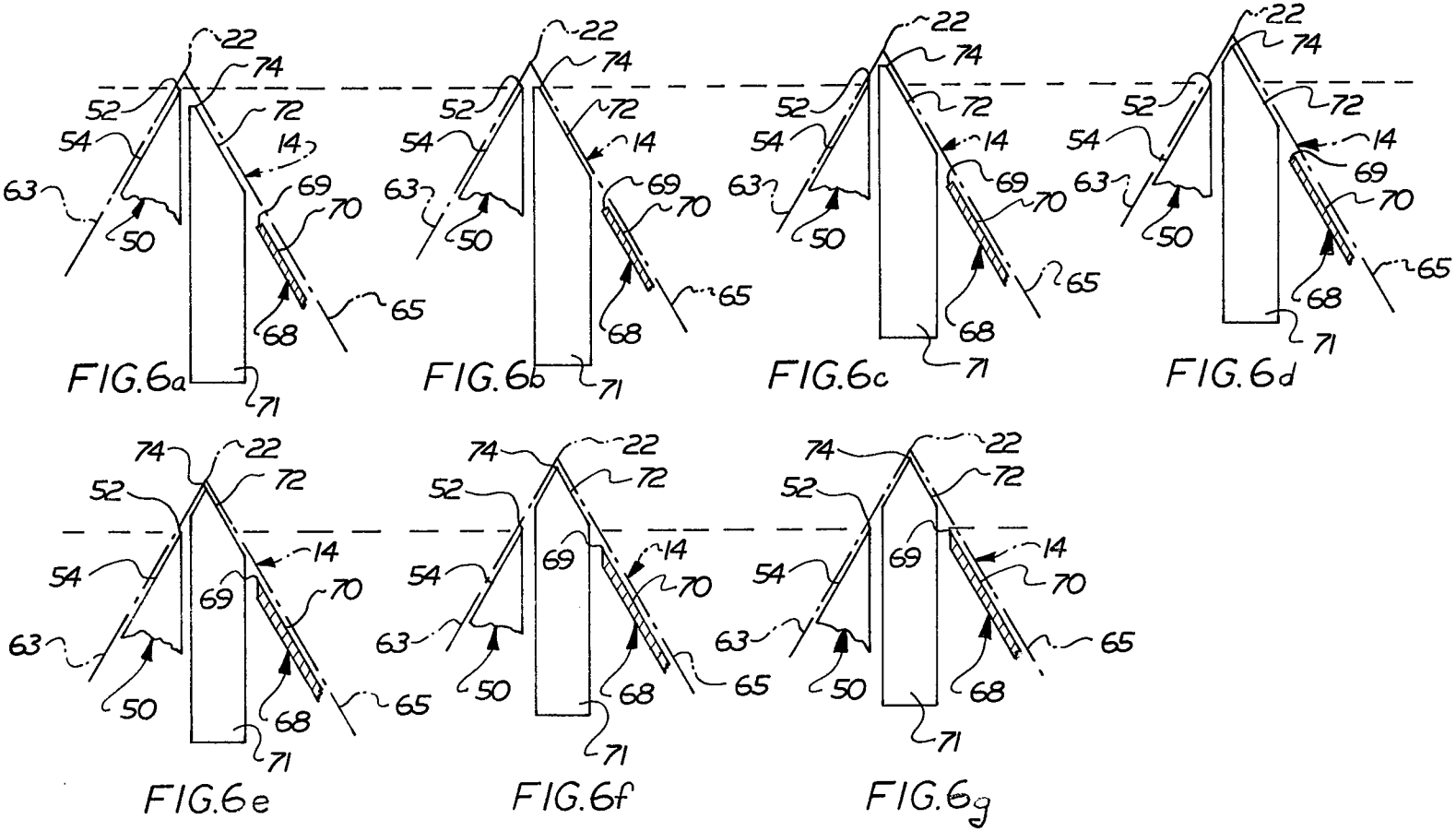
FIG. 6 is a sequential series of schematic illustrations showing changing positions of the fold guide relative to the steeples and the support member and exemplifying the lifting and centering of the folded backbone of the signature as the signature moves downstream on the conveyor from the line 5—5 to the line 7—7 of FIG. 2.
Figure 7:
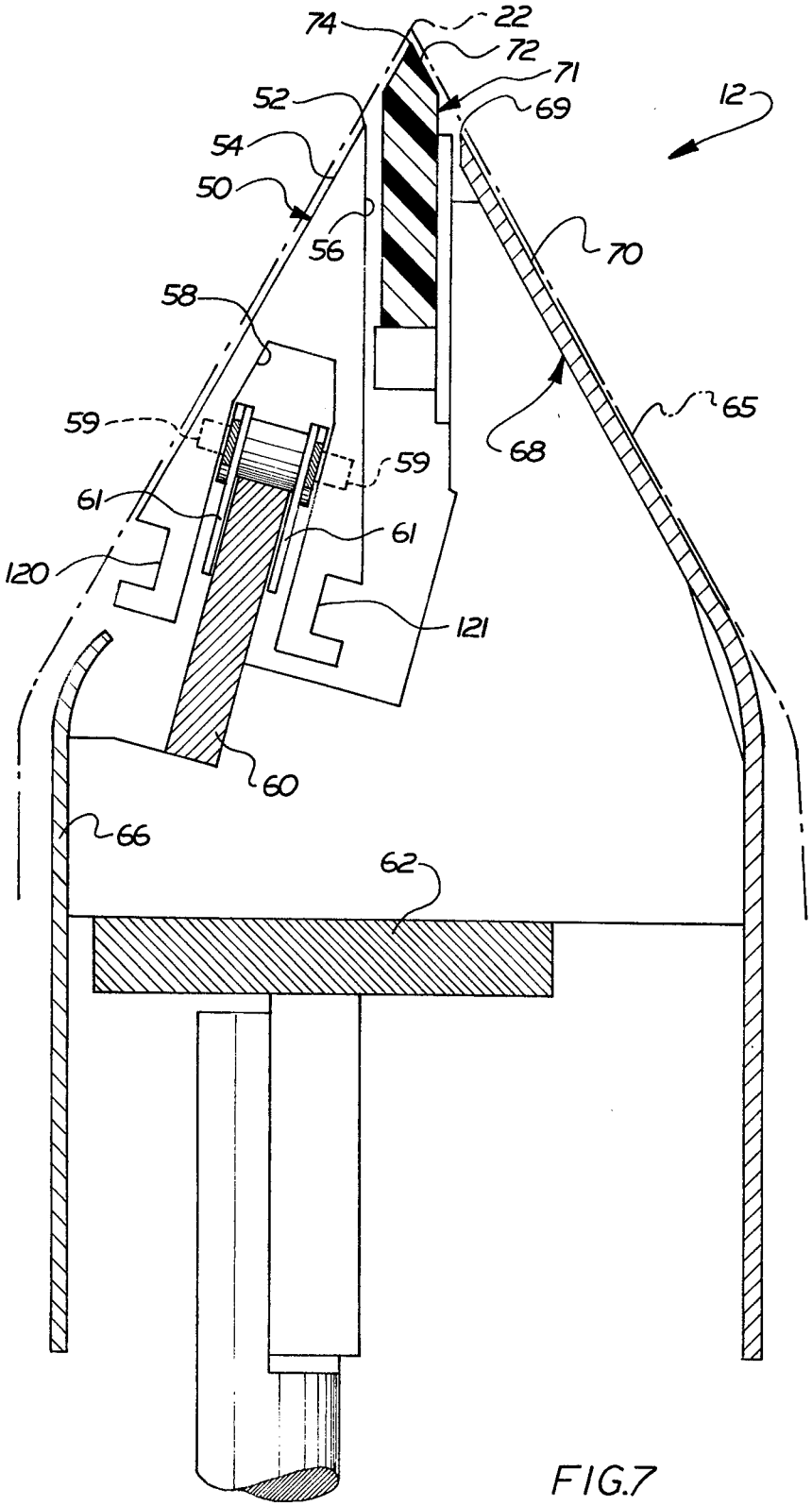
FIG. 7 is a cross sectional view taken along the line 7—7 of FIG. 2 illustrating the chain of the saddle conveyor fully tilted with the fold guide engaging the folded backbone of the signature between the steeple on the chain and the stationary support member.

FIG. 6 illustrates the changing position of the fold guide 71 relative to the steeple 50, the support member 68, and the backbone 22 of a signature 14 as the signature moves downstream between the locations of FIGS. 5 and 7 along the path of the conveyor 12.

FIG. 6*a* shows the fully twisted position of the chain 16. The fold guide 71 is below the backbone 22 and face 72 supports the righthand (as viewed in FIG. 6) leaf 65 of the signature 14. The fold guide 71 slopes upward (FIG. 6*b*), and it contacts the backbone 22 as the signature 14 moves downstream. Thereafter the fold guide 71 lifts the signature 14 from the apex 52 of the steeple (FIG. 6*c*) and the backbone 22 is transferred to an apex or upper edge 74 on the fold guide 71 (FIG. 6*d*).

As viewed in a plan view, i.e., from above, the apex 74 of the fold guide 71 extends diagonally half way across the top of the fold guide. This can be seen in FIG. 6 as the apex 74 appears to shift from the left edge of the fold guide in FIG. 6*d* to the center of the fold guide in FIG. 6*g* and FIG. 7. The apex 74 also slopes upward relative to the steeple 50. As the conveyor 12 moves a signature 14 over the fold guide 71, the backbone 22 of the signature is lifted vertically and moved horizontally away from the steeple 50 by the apex 74 of the fold guide. This motion positions the backbone 22 of the signature 14 for the stitcher station 34.

Figure 8:
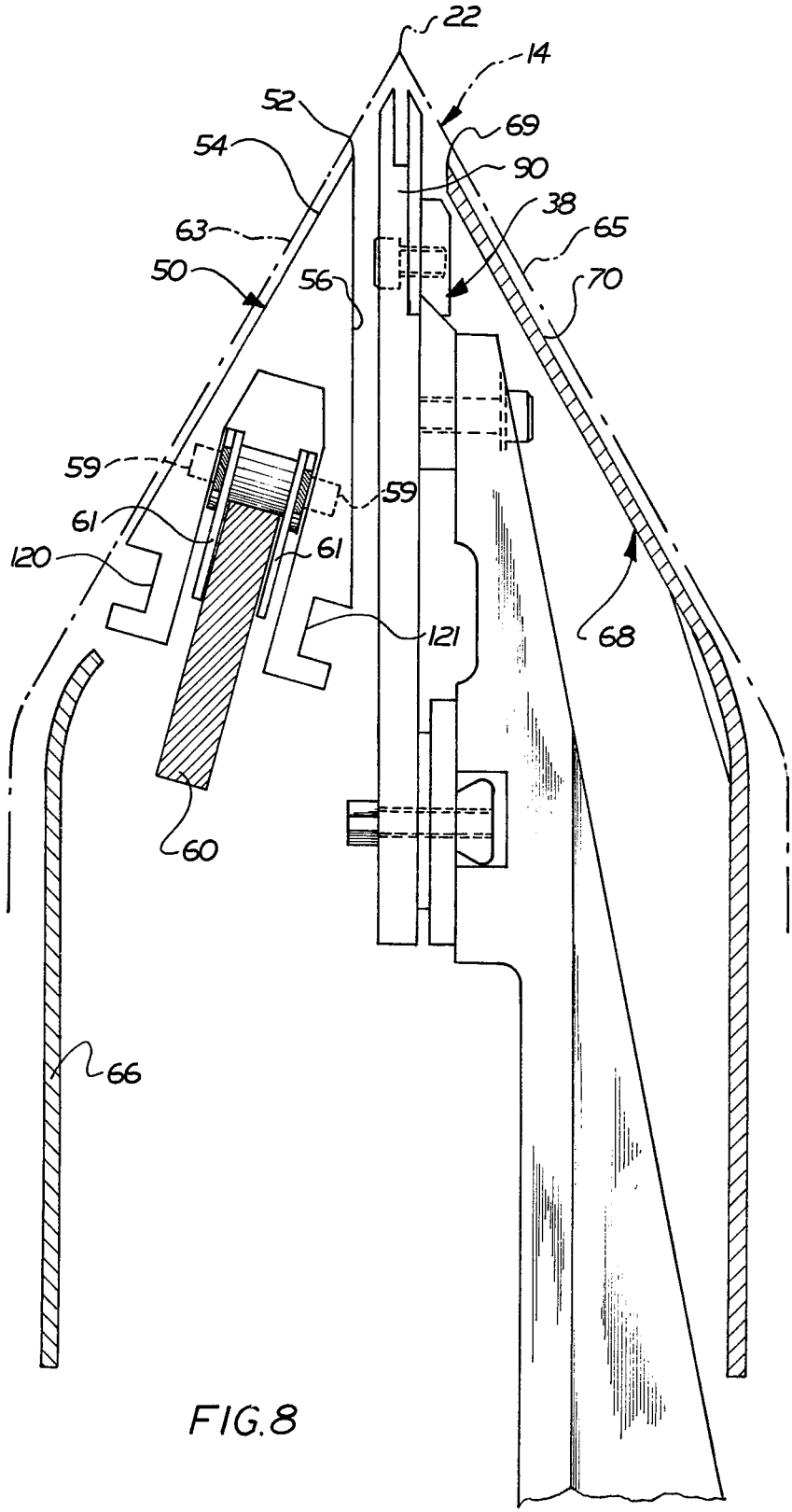
FIG. 8 is a cross sectional view taken along the line 8—8 of FIG. 2 illustrating the fully tilted chain of the saddle conveyor at a stitching station with a clincher projecting between the steeple and the stationary guide rail upward in the centerfold of the signature toward its backbone.

The fold guide 71 extends along the path of the conveyor 12 until just before the stitching station 34. While passing through the stitching station 34 the signature 14 continues to be supported by the first face 54 of the steeple and the support member 68. The stitching station 34 includes a conventional clincher assembly 38 (FIG. 8) which moves upward in the centerfold between the second face 56 of the steeple and the support member 68 to reach the backbone 22. The clincher assembly 38 and the stitcher 36 are secured to a reciprocating support frame 96 driven from below the steeple 50 and chain 16 so that the stitching station 34 may operate while the signature 14 continues to move in the direction of the arrow 20 (FIG. 2).

Figure 9:
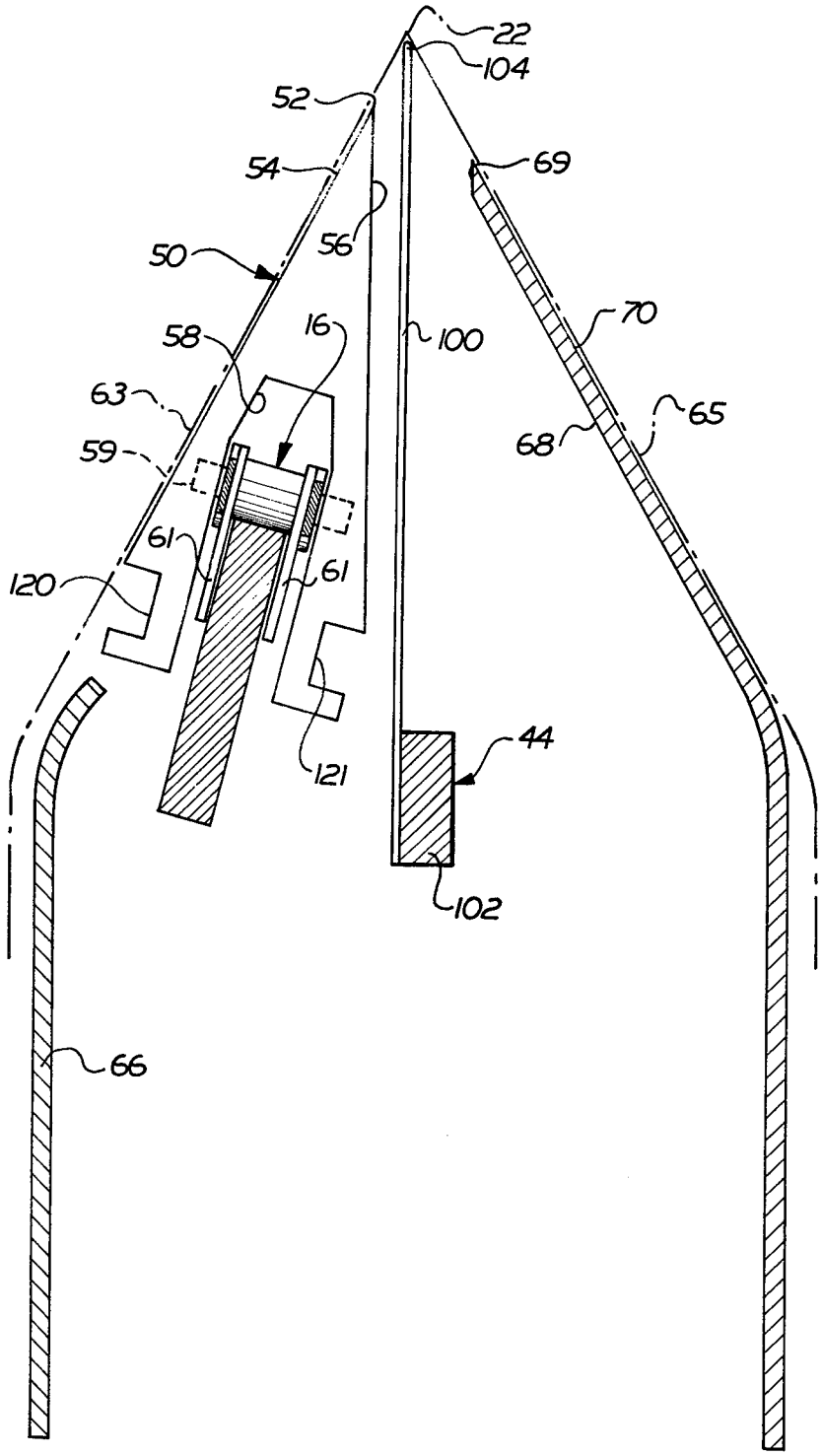
FIG. 9 is a cross sectional view taken along the line 9—9 of FIG. 2 illustrating the chain of the saddle conveyor fully tilted with a reciprocable blade of the unloading or transfer station projecting toward the backbone of the signature between the steeple and the guide rail.

Downstream of the stitching station 34 the signatures 14 are lifted from the conveyor 12 to the conveyor 46 by the transfer station. A reciprocable assembly 44 has an initial position below the chain 16 of the conveyor 12 and in line with the backbone 22 of the signature 14. When the entire signature 14 is located within the transfer station 42, the reciprocable assembly 44 moves upward in the centerfold toward the backbone 22 (FIG. 9).

The reciprocable assembly 44 includes a blade 100 which is mounted on a frame 102. As the reciprocable assembly 44 moves, the blade 100 moves between the second face 56 of the steeple and the guide member 68. An upper end portion 104 of the blade 100, contacts the backbone 22 of the signature and lifts the signature 14 from the saddle conveyor 12. The reciprocable assembly 44 then moves downward after delivering the signatures 14 to the secondary conveyor, returning to its initial position beneath the backbone 22 of the signatures.

At each end of the saddle conveyor 12, a wheel 112 (FIG. 10) (only one shown) engages the chain 16. The wheel 112 is driven by a motor (not shown) and a gearbox 115 mounted on the machine frame 62. As described above, at the upstream end of the conveyor path the steeples 50 on the chain 16 are vertical, and subsequently they are twisted 15°. The chain 16 remains twisted throughout its contact with the downstream wheel 112. Therefore, the wheel rotates in a plane at a 15° angle with vertical.

The process of straightening the chain 16 occurs during the return path 110. The steeples 50 include channels 120 and 121 at the base of each of the first 54 and second 56 faces, respectively. Bars 122 and 123 extend into the channels 120 and 121, respectively, of the steeples 50 along the return path 110 and serve to realign the chain 16 during the return path 110. The bars 122 and 123 also assure that the chain 16 and steeples 50 do not become unnecessarily slackened along the return path 110 by forming a track upon which the steeples 50 ride.

Figure 10:
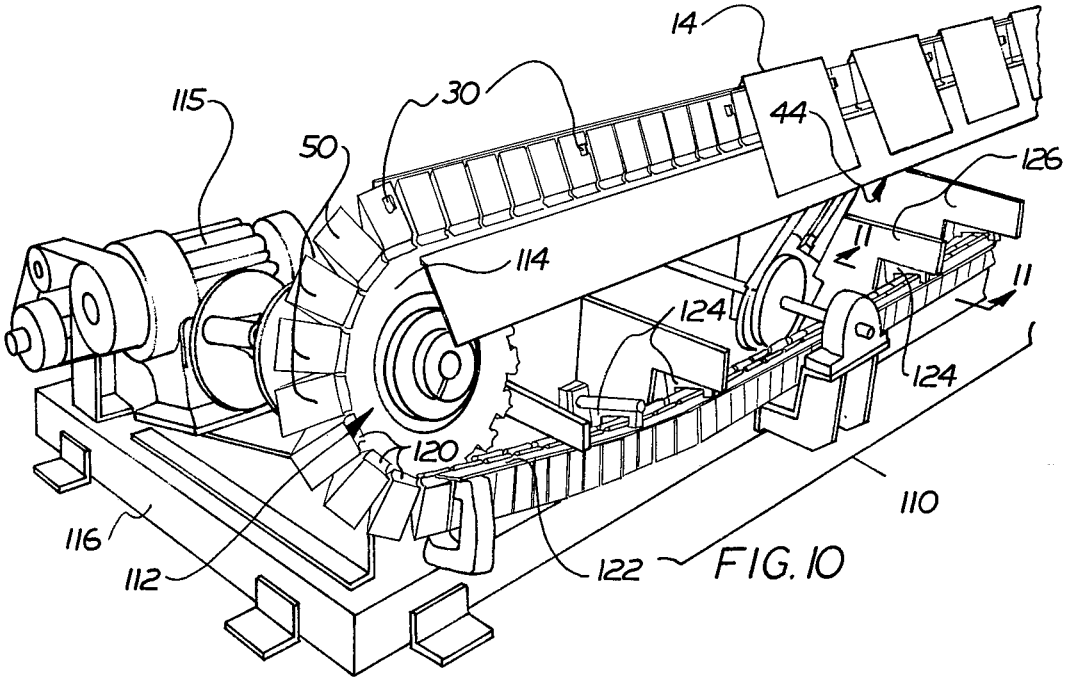
FIG. 10 is a perspective view illustrating a return path of the saddle conveyor and the process of straightening the chain and steeples from the tilted position to a straight position.
Figure 11:
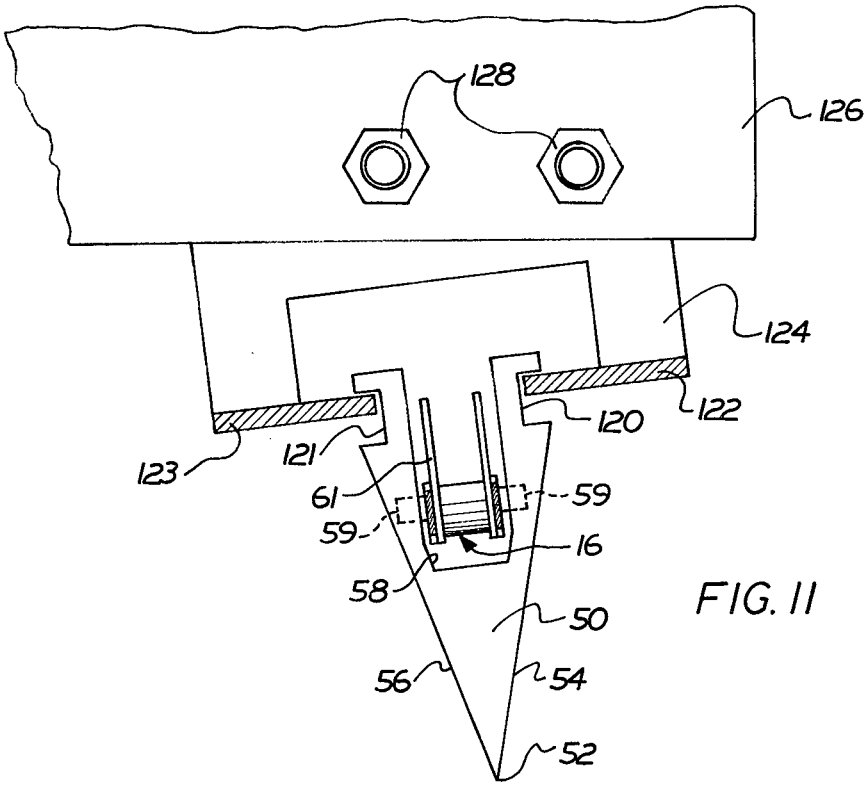
FIG. 11 is a cross sectional view taken along the line 11—11 of FIG. 10 illustrating one of the devices used to straighten the chain from the tilted postion to the straight position as the chain travels the return path.

U-shaped brackets 124 which are suitably mounted to the frame members 126 (FIG. 11) support the bars 122 and 123 at a number of locations along the return path 110. Succeeding brackets 124 and frame members 126 are angled relative to one another (FIG. 10). The angle between the pitch line of the chain 16 and a horizontal line (FIG. 11) is gradually reduced to 0° as a result of the brackets 124. The wheel (FIG. 1) which engages the chain 16 near the inserter station 26 rotates in a vertical plane and supports the steeples 50 with their center lines vertical.

Thus it is clear that the present invention provides a new and improved signature conveyor 12 (FIG. 1) for use in transporting signatures 14 along a path through a variety of stations 26, 34, and 42 at each of which a work operation is performed. The present invention enables a single chain conveyor to carry a continuously moving stream of signatures from a collating station 26 through a stitcher station 34 to a transfer station.

The collating station 26 requires support for a folded back edge or backbone 22 of the signature from below, and other stations (34 and 42) require unobstructed access to both the top and bottom sides of the backbone 22 which must be accurately positioned in order for the station to perform its operation. A signature conveyor 12 constructed according to the present invention provides signature supports or steeples 50 (FIG. 3) which support the folded backbone 22 of a signature 14 where that is required and which can twist out of the way to provide access from the center fold to the bottom of the backbone 22 where that is required.

Each steeple 50 has two sloping sides 54 and 56 which meet to form an apex or ridge 52 on which the folded backbone 22 of a signature 14 may rest. The signature 14 travels with the backbone 22 uppermost and in the direction of the fold while the leaves 63 and 64 of the signature rest on the sloping sides 54 and 56 of the steeple 50. When support is required directly beneath the backbone 22, the steeple 50 is oriented with its apex 52 uppermost, and the sloping sides 54 and 56 are symetrical about a vertical line through the apex. When access to the backbone 22 from the centerfold is required, the steeple 50 is twisted out of vertical (FIG. 4) so that one of the (formerly) sloping sides 56 becomes upright. One leaf 63 of the signature 14 remains supported by the steeple 50. The other leaf 65 slides along a face 70 of a support member 68 which is positioned for this purpose along the portion of the signature path where the steeples are twisted from vertical.

The steeples 50 are mounted on an endless chain 16 which in turn is supported and guided by a guide rail 60. The links of the chain 16 have downward extensions 61 of the link plates which fit and slide along opposite sides of the guide rail 60 while the rollers of the chain rest on the top surface of the guide rail. When the steeples 50 must be vertical, the guiding sides of the guide rail 60 are vertical, and the top surface is horizontal. Further along the signature path, where there must be access to the backbone 22 of the signatures 14 from below, the sides of the guide rail 60 are slanted off vertical. The link plates 61 follow the sides of the guide rail 60 and twist the steeples 50 so that one 56 of the (formerly) sloping sides of the steeple becomes vertical.

To provide access to the backbone 22 of the signatures 14, the signatures are lifted away from the apex 52 of the steeples 50 by a support member and a fold guide. The support member 60 has a face 70 which extends along the conveyor path to support one leaf 65 of the signatures. The top edge 69 of this face 70 slopes upward with respect to the axis of the guide rail 60. As the signatures 14 move along the conveyor 12, and reach the portion where the guide rail 60, chain 16, and steeples 50 twist, the signatures are opened by an outward flare of a face 70 of the support member 68.

As mentioned above, the stitcher 34 performs an operation requiring access to both the top and bottom of the backbone 22 of the signature 14, and the backbone must be accurately located. To this end the conveyor 12 includes a fold guide 71 (FIG. 5) which is accurately located relative to the stitcher station. When the steeples 50 have twisted so that one leaf 63 of a signature is supported by the steeples and the other leaf is supported by the signature support 68, the fold guide 71 engages the folded backbone 22 from below to position it properly with respect to the station 34.

The fold guide 71 (FIG. 7) is an elongated member extending generally parallel to the direction of the conveyor 12. The fold guide 71 slants upwardly so that its upper portion increasingly engages the folded back edge or backbone 22 of the signature as the signature 14 moves along the conveyor. When the signature 14 arrives at the end of the fold guide 71, the backbone 22 and the portions of the leaves 63 and 65 immediately adjacent the backbone are supported by the fold guide. The lower portion of one leaf 65 is supported by one side 54 of the tilted steeple, and the lower portion of the other leaf 65 is supported by the face 70 of the support member 68.

Once properly aligned, the signatures 14 pass through a station such as a stitcher 34 (FIG. 8) where wire stitches are pressed through the backbone 22. Thereafter the signatures 14 are conveyed to a transfer station 42 (FIG. 9) at which it is also required that the backbone 22 be accessable from below. Therefore the chain guide rail 60 remains twisted from vertical for the length of this transfer station.

The drive sprocket 112 (FIG. 10) at the downstream end of the conveyor 12 is slanted to receive the chain 16 in a twisted condition as it moves off from the end of guide rail 60. On the return run chain 16 is guided by supports 112 and 122 (FIG. 11) which engage the steeples. Along the length of the return run the steeple supports 121 and 122 gradually twist the steeples 50 and the chain 16 until they again lie in a vertical plane. For this reason the sprocket (not shown) at the upstream end of the conveyor 12 rotates in a vertical plane, and the chain comes off the upstream sprocket vertically aligned with the upstream end of the chain guide rail 60.

Having described on specific preferred embodiment of the invention, the following is claimed:

1. An assembly for transporting a signature folded along a line to form two leaves, said assembly comprising a signature support means for moving said signature support along a path, said signature support having a pair of sloping faces which meet to form an apex which is parallel with said path, guide means for varying the orientation of said signature support as it moves along said path between an upright position in which the signature support is centered below the fold of the signature with one leaf of the signature resting on one face of the support and the other leaf resting on the other face of the support and a tilted position in which only a first leaf of the signature rests on a face of the support, a support member having a face extending in the direction of said path, and the second leaf of the signature resting on said face of said support member when said signature support is in the tilted position.

2. An assembly as set forth in claim 1 wherein said sloping faces of said signature support are disposed at a first angle to each other, said one face of said signature support on which a side of the signature rests when said signature support is in the tilted position and said face of said support member on which the second side of the signature rests forming a second angle, said second angle being less acute than said first angle.

3. An assembly as set forth in claim 1 further including a plurality of signature supports identical to said signature support, said means for moving said signature support including a conveyor chain following said path, said signature supports being connected with said chain at spaced intervals along said chain.

4. An assembly as set forth in claim 3 wherein said chain is a roller chain and further including a chain guide, said guide means having surfaces for supporting said chain and for changing the orientation of said chain and said signature supports as said chain and signature supports move along said path, said guide means having an upstream portion in which said surfaces maintain said sides of said signature supports symmetrically disposed about a vertical line and a downstream portion in which said surfaces are twisted relative to their upstream position to maintain said sides of said signature support symmetric about a line which forms an acute angle with a vertical line.

5. An assembly as set forth in claim 4 further including an upstream and a downstream wheel engaging said chain and delimiting the upstream and downstream ends of said path, guide means including a portion in which said chain supporting surfaces are twisted in a helical form, the axis of said helical form being a straight line on which the centers of the rollers of said chain lie for the length of said path.

6. An assembly as set forth in claims 3, 4 or 5 wherein said conveyor chain includes only a single conveyor chain following said path and to which said signature supports are connected.

7. An assembly as set forth in claim 1 further including a fold guide for accurately positioning the fold of the signature, said fold guide having an axially extending apex between the leaves of the signature and sloping upward along the conveyor path from an upstream location below the level of the apex of said signature support to a downstream location above the level of said signature to engage the fold of the signature from below when said signature support is in the tilted position, whereby the signature is lifted upward by said fold guide relative to said apex of said signature support as the signature moves downstream on the signature conveyor.

8. An assembly as set forth in claim 7 wherein said fold guide includes an apex upon which the fold of the signature rests, said apex extending at an angle to the path of said conveyor from a downstream position adjacent to said apex of said steeple to an upstream position spaced horizontally from said apex of said steeple whereby the signature is displaced horizontally by said fold guide relative to said apex of said signature support as said signature moves downstream on the signature conveyor.

9. An assembly as set forth in claim 8 further including stitcher means for stitching the signature, said fold guide being aligned with said stitcher means to accurately position the fold of the signature relative to said stitcher means.

10. An assembly for transporting and stitching a group of signatures each of which is folded along a line to form two leaves, said assembly comprising a signature support, means for continuously moving said signature support along a path, said signature support having a pair of faces which meet to form an apex which is parallel to said path, guide means for varying the orientation of said signature support as it moves along said path between an upright position in which said signature support is centered below the fold of the signatures with one leaf of the signatures resting on one face of the signature support and the other leaf of the signatures resting on the other face of the signature support and a tilted position in which only a first leaf of the signatures rests on the signature support, a support member having a face extending in the direction of said path, the second leaf of the signature resting on said face of said support member when said signature support is in the tilted position, and stitching means for stitching the group of signatures together including a clincher mounted for movement toward said fold from below when said signature support is in said tilted position.

11. An assembly as set forth in claim 10 further including a plurality of hoppers located along said conveyor path from which signatures are fed to form said groups of signatures, said signature support being oriented in the upright position as it moves past said hoppers.

12. An assembly as set forth in claim 11 wherein said means for moving said signature support includes an endless roller chain to which said signature support is connected, and said guide means includes a first straight portion adjacent said hoppers in which said signature support is upright, and a second straight portion adjacent said stitching means in which said signature support is twisted, and an intermediate portion between said first and second portions and twisted in a helical form, said first and second portions being aligned so that the same straight line passes through the centers of the chain rollers in both portions, the helical portion having an axis coincident with said same straight line.

* * * * *